US008947265B2

(12) United States Patent
Bernard et al.

(10) Patent No.: US 8,947,265 B2
(45) Date of Patent: Feb. 3, 2015

(54) SIGNAL TIMING COORDINATION SYSTEM FOR CROSSWALK BEACONS

(71) Applicant: Carmanah Technologies Corp., Victoria (CA)

(72) Inventors: Bruce Bernard, North Vancouver (CA); Darren Beckwith, Victoria (CA)

(73) Assignee: Carmanah Technologies Corp., Victoria, BC (CA)

( * ) Notice: Subject to any disclaimer, the term of this patent is extended or adjusted under 35 U.S.C. 154(b) by 13 days.

(21) Appl. No.: 13/788,096

(22) Filed: Mar. 7, 2013

(65) Prior Publication Data

US 2014/0197969 A1 Jul. 17, 2014

(30) Foreign Application Priority Data

Jan. 14, 2013 (CA) ..... 2801686

(51) Int. Cl.

| | |
|---|---|
| ***G08G 1/095*** | (2006.01) |
| ***G08G 1/07*** | (2006.01) |
| ***F21S 10/00*** | (2006.01) |
| ***G08B 5/38*** | (2006.01) |

(52) U.S. Cl.

CPC ..... *G08B 5/38* (2013.01)
USPC ..... 340/944; 340/925; 116/202

(58) Field of Classification Search

CPC ..... G08G 1/095; G08G 1/07; G08B 1/00; G08B 1/08; H04W 40/00; H04J 14/08; H04B 10/00
USPC ..... 340/944
See application file for complete search history.

(56) References Cited

U.S. PATENT DOCUMENTS

| | | | | |
|---|---|---|---|---|
| 5,252,969 | A | 10/1993 | Kishi | |
| 5,812,056 | A * | 9/1998 | Law | 340/539.15 |
| 6,384,742 | B1 | 5/2002 | Harrison | |
| 7,218,682 | B2 | 5/2007 | Mayor et al. | |
| 7,266,141 | B2 | 9/2007 | Goodings | |
| 7,317,405 | B2 * | 1/2008 | Green et al. | 340/907 |
| 7,429,919 | B2 | 9/2008 | Silic et al. | |
| 7,586,421 | B2 | 9/2009 | Witte et al. | |
| 7,852,234 | B1 | 12/2010 | Borenstein et al. | |
| 7,859,431 | B2 | 12/2010 | Peddie et al. | |
| 8,019,012 | B2 | 9/2011 | Yellapantula et al. | |
| 8,081,087 | B2 | 12/2011 | Jones | |

OTHER PUBLICATIONS

Godavati et al., "Diversity and Degrees of Freedom in Wireless Communications", dated 2002, 4 pages.
Diggavi, Suhas, "Diversity in Communication: From Source Coding to Wireless Networks", dated 2005, 52 pages.

* cited by examiner

*Primary Examiner* — Jennifer Mehmood
*Assistant Examiner* — John Mortell
(74) *Attorney, Agent, or Firm* — Hickman Palermo Truong Becker Bingham Wong LLP

(57) ABSTRACT

A signal or lighting system synchronizes the flashing of multiple signal or lighting assemblies. When one of the assemblies is triggered, it broadcasts a temporally staggered sequence of signals, each signal instructing the receiving assemblies to initiate flashing of their beacons a given countdown time after that particular signal is transmitted. The countdown times of the various signals all count down to the same flashing start time so that the originating and receiving beacons all being flashing at the same time. The temporal diversity of the signals enhances the ability to overcome potential interference as at least one of the signals in the sequence is likely to be received by the destination assemblies.

20 Claims, 8 Drawing Sheets

SIGNAL TIMING COORDINATION SYSTEM FOR CROSSWALK BEACONS

FIELD OF THE INVENTION

This invention relates to wireless-enabled signal or lighting assemblies. In particular, this invention relates to a means of synchronizing multiple crosswalk warning beacons upon activation of one of them.

BACKGROUND OF THE INVENTION

Traffic engineers have many options when dealing with pedestrian traffic crossing a road. These include a simple painted crosswalk, posted pedestrian crosswalk signs and flashing beacons mounted along and sometimes in the roadway.

Where flashing beacons are used, several beacons may be arrayed around a particular crosswalk including along the roadway in both directions, on a meridian or on an island in the roadway. A complete system may have as many as 6 separate crosswalk assemblies and/or beacons around a single crosswalk.

Crosswalk beacons may often be actuated manually by a pedestrian at one of the beacons around a crosswalk. In other cases, the beacons may be triggered by a proximity or motion sensor. Whatever form it may take, the triggering event associated with a particular beacon causes that beacon to begin flashing. Where more than one beacon is arrayed around a crosswalk, it is known to use wireless communication from the triggering beacon to communicate with the other beacons in order to synchronize their flashing to that of the triggering beacon. Typically, the triggering beacon broadcasts a timing pulse used by the other beacons to cause the onset of their flashing.

Wireless crosswalk assemblies typically operate on the locally available unlicensed frequency bands such as the 902-928 MHz band in North America and the 2.4 GHz band in most of the world. However, the use of the same bands by many other devices can cause interference, such as from radio or WiFi sources such as homes, coffee shops, internet cafes, supermarkets and various businesses. As the interference affects a crosswalk signal, one of the beacons may not flash, or may not be properly synchronized, putting pedestrians and vehicular traffic at risk.

U.S. Pat. No. 7,586,421 to Witte et al. discloses a system for minimizing interference among traffic signal devices. The devices are grouped by colour or other designating indicia and each group communicates on a different frequency.

U.S. Pat. No. 5,252,969 to Kishi discloses a temporary traffic signal system wherein a pair of signal stands are installed at spaced locations. A variety of means are disclosed to synchronize the signals, including manually triggering both signals at the same time, a "parent" stand wirelessly transmitting to a "child" stand an initialization signal, and signalling by means of light or sound. The system involves two-way communication between the traffic devices of a group to allow feedback verifying that the devices are synchronized. In the event that they are not, or in the absence of a communication signal, the devices switch to a default flashing mode.

U.S. Pat. No. 7,266,141 to Goodings discloses an example of a time division multiple access frequency hopping communications system for avoiding interference.

Diggavi, Suhas, Diversity in Communication: From Source Coding to Wireless Networks, a paper apparently published before 2005, addresses the concept of diversity to ensure the integrity of communication channels, notably through the use of multiple antennas, multiple users and multiple routes.

Godavari, Mahesh and Hero III, Alfred O., Diversity and Degrees of Freedom in Wireless Communications, considers signal diversity principally from the point of view of providing redundancy of communication channels.

It is therefore a general object of this invention to synchronize the flashing of the beacons at wireless-enabled lighting or other signal assemblies with the operation of a triggering beacon.

It is a more particular object of the invention to enhance the reliability of wireless synchronization between beacons of a pedestrian-controlled crosswalk.

These and other objects of the invention will be better understood by reference to the detailed description of the preferred embodiment which follows. Note that not all of the objects are necessarily met by all embodiments of the invention described below or by the invention defined by each of the claims.

SUMMARY OF THE INVENTION

According to one aspect of the invention, when a synchronization control signal is to be communicated by signal or lighting assembly to other assemblies, the synchronization control signal is configured as a temporally staggered sequence of broadcasts. Each of the broadcasts in the sequence instructs the receiving assembly to initiate the flashing of its beacon a given countdown time after that signal is transmitted. Each broadcast signal's countdown time is a function of that signal's transmission time delay in relation to the first signal in the sequence so that the countdown times of the various signals all count down to the same flashing start time. As a result, the various signals in the sequence all effectively indicate a common beacon flashing start time. The triggering assembly's beacon is also timed to commence flashing at the same common flashing start time. This temporal diversity of the signals enhances the ability to overcome potential interference as at least one of the plurality of signals in the sequence is likely to be received by the destination assemblies.

The invention avoids the need to use frequency diversity thereby simplifying the set up and installation of the system and rendering such set up less subject to the local interference environment. Although the invention avoids the need to use frequency diversity, it may also be applied in addition to frequency diversity or other signals spreading algorithms, such as frequency hopping or direct sequence modulation. Such redundancy may provide an additional level of protection against lost or corrupted signals.

In another aspect of the invention, the flashing initiation time delay that is communicated by each signal in the sequence is communicated by assigning a sequence number to the signal. The destination assembly associates each sequence number with a predetermined countdown time before initiation such that provided it receives at least one of the signals, it can determine the initiation or start time.

In one of its aspects, the invention is a method of synchronizing a plurality of crosswalk warning signal or lighting assemblies. The method comprises the steps of, in response to a triggering event at an originating one of the signal or lighting assemblies, the originating assembly broadcasting a temporal succession of radio signals on the same radio channel. Each of the signals comprises a unique flashing initiation timing instruction that is a function of how long in advance of a desired flashing initiation time the signal is broadcast. At least one other of the assemblies receives at least one of the signals and determines the desired flashing initiation time. The originating assembly and the at least one other assembly cause beacons on their respective assemblies to flash in a synchronized manner in response to receiving at least one of the signals. The triggering event may be the manual activation of a user interface on the originating assembly.

In a further aspect, the step of broadcasting comprises the steps of configuring a set of radio signals to be broadcast in timed succession, each of the signals comprising a unique flashing initiation timing instruction that is a function of how long in advance of a desired flashing initiation time the signal is to be broadcast and broadcasting each signal in the set of signals in temporal succession.

In a further aspect, the instruction comprises the actual time period in advance of the desired flashing initiation time that each of the signals is broadcast. In another aspect, the instruction may comprise a token representing the position of the signal in the temporal sequence of signals that are broadcast by the originating assembly. Each of the assemblies may associate the token with a predetermined time period in advance of a flashing initiation time.

In a further aspect, the invention further comprises the step of each of the receiving assemblies monitoring for receipt of another of the signals until the desired flashing initiation time and, where a signal is received, allowing the signal to determine the desired flashing initiation start time.

In yet a further aspect, the invention further comprises the step of each of the receiving assemblies monitoring for another triggering event at the respective receiving assembly until the desired flashing initiation time and, where a triggering event is detected, treating the receiving assembly as an originating one of the assemblies.

In a further aspect, the invention further comprises the steps of the originating and receiving assemblies allowing a predetermined time period to elapse after a broadcast of one of the signals that has been received by one of the receiving assemblies, and determining whether another signal has been received or another triggering event has occurred during the predetermined time period, and if not, allowing another predetermined time period to elapse if the desired flashing initiation start time has not yet been reached.

In another aspect, the invention comprises a signal or lighting assembly. The assembly comprises a beacon, radio signal receiving and broadcasting means and a user interface for allowing a user to trigger the flashing of the beacon. The assembly further comprises a computer readable medium having stored thereon instructions that, when executed by a processor, cause the following steps to be implemented: in response to an activation of the user interface, the assembly broadcasting a temporal succession of radio signals on the same radio channel, each of the signals comprising a unique flashing initiation timing instruction that is a function of how long in advance of a desired flashing initiation time the signal is broadcast, and causing the beacon to begin flashing at the desired flashing initiation time; in response to receipt from another like assembly of a like radio signal, causing the beacon to begin flashing at a flashing initiation time determined by the like radio signal.

In another aspect, the invention comprises a signal or lighting system. The system comprises a plurality of signal or lighting assemblies, each of the assemblies comprising a beacon, radio signal receiving and broadcasting means and a user interface for allowing a user to trigger the flashing of the beacon. Each of the assemblies further comprising a computer readable medium having stored thereon instructions that, when executed by a processor, cause the following steps to be implemented: (1) in response to an activation of the user interface of an originating one of the assemblies, the originating assembly broadcasting a temporal succession of radio signals on the same radio channel, each of the signals comprising a unique flashing initiation timing instruction that is a function of how long in advance of a desired flashing initiation time the signal is broadcast, and causing the beacon to begin flashing at the desired flashing initiation time; (2) at least one other of the assemblies receiving at least one of the signals and determining the desired flashing initiation time; and (3) the originating assembly and the at least one other assembly causing beacons on their respective assemblies to flash in a synchronized manner in response to receiving at least one of the signals.

In yet another aspect of the invention, the signal or lighting assemblies may be crosswalk warning assemblies.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT OF THE INVENTION

Figure 1:
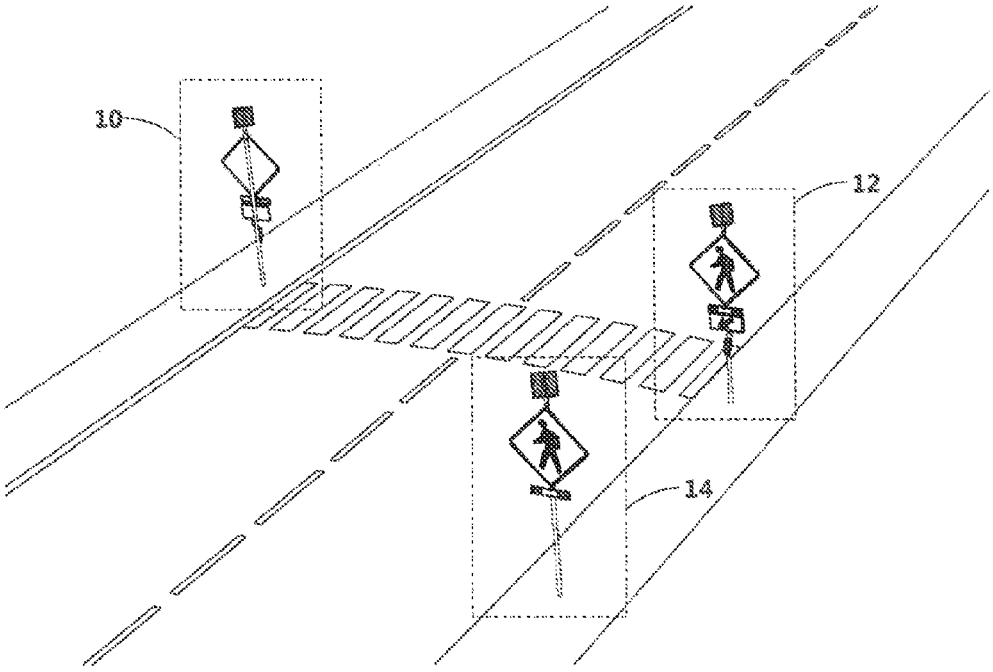
FIG. 1 is a diagrammatic view of a crosswalk warning system showing three crosswalk warning assemblies including beacons in the vicinity of a crosswalk.

FIG. 1 illustrates a crosswalk warning system according to the preferred embodiment comprising a plurality of crosswalk assemblies 10, 12 and 14 that are intended to cause their respective beacons to flash in a synchronized manner.

Figure 2:
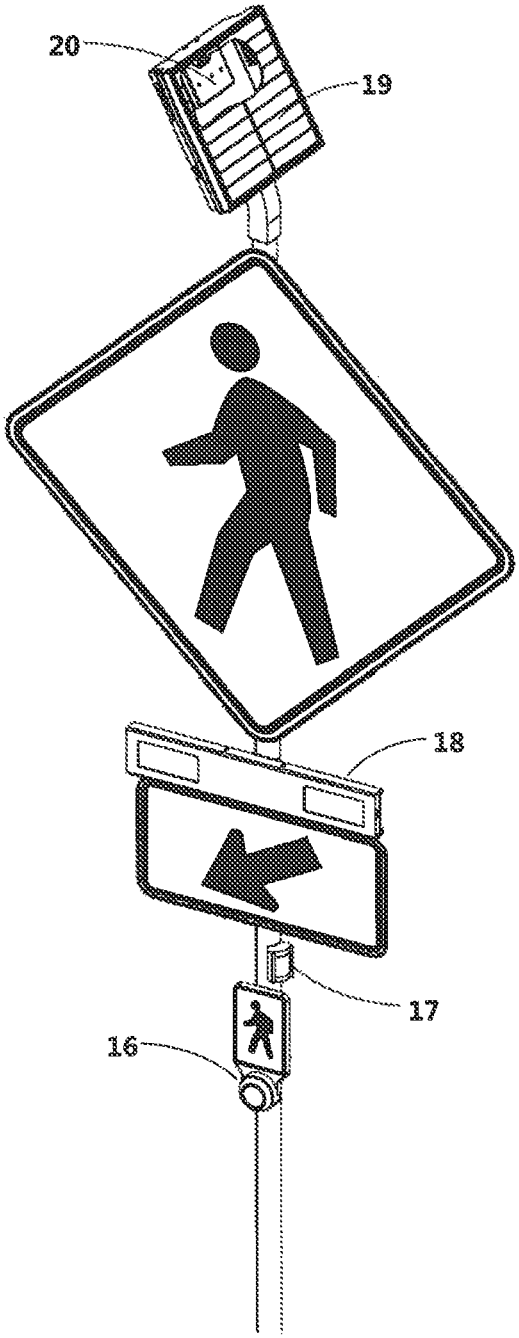
FIG. 2 is an isometric view of a crosswalk warning assembly according to the preferred embodiment.

Referring also to FIG. 2, assemblies 10 and 12 include a pedestrian activation button (or other user interface) 16 enabling a pedestrian to manually activate the crosswalk warning system. Alternatively, the crosswalk warning system may be activated by a proximity or motion sensor 17 or by other local means associated with assembly 10 or 12. Signal beacons 18, a suitable one being the Tomar Rect37™, are mounted on each assembly 10, 12 or 14. A microcontroller unit 20 and a solar panel 19 are associated with each assembly 10, 12 or 14.

Figure 3:
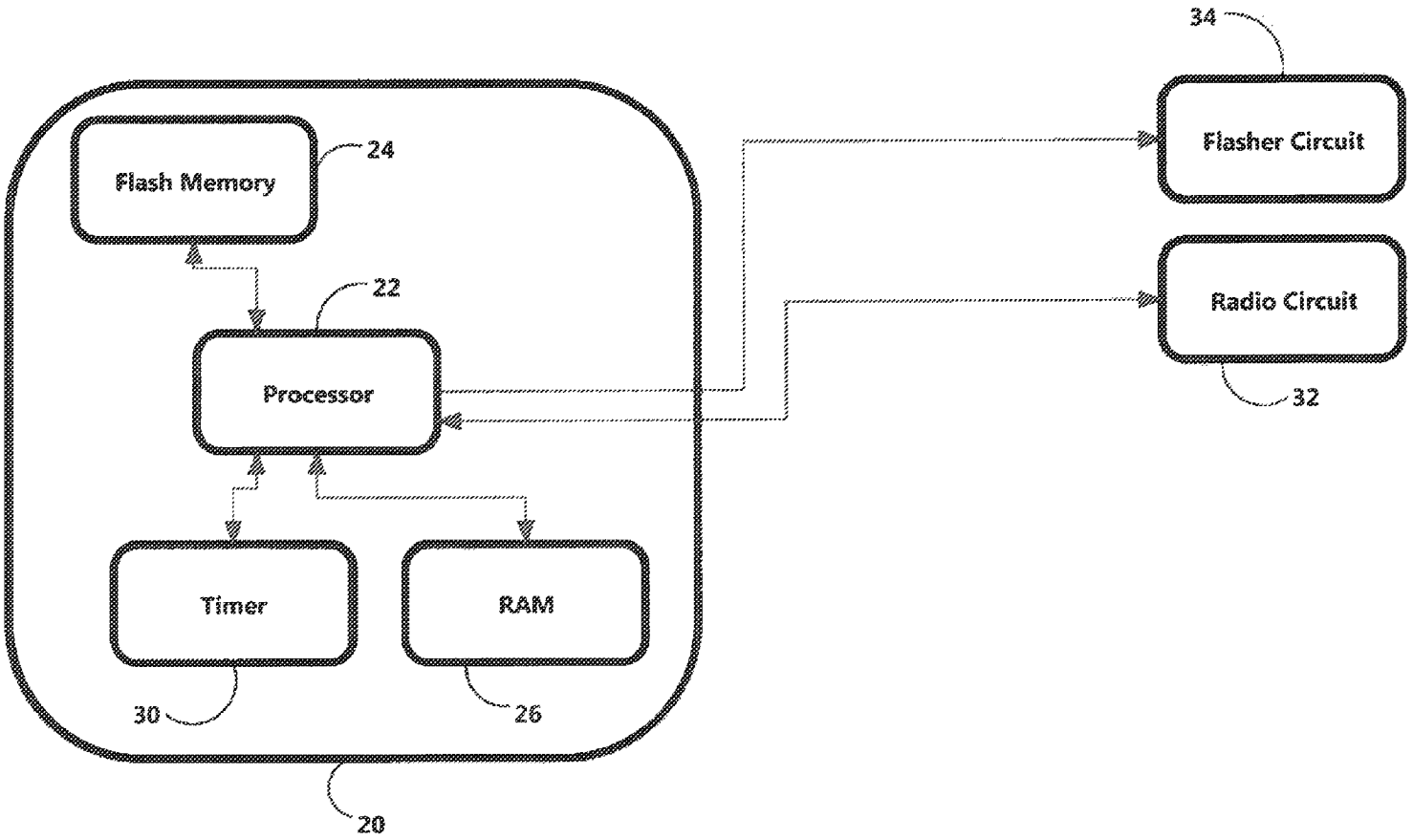
FIG. 3 is a block diagram of the control system of the preferred embodiment of the invention.

Referring to FIG. 3, the microcontroller unit 20 comprises a processor 22, flash memory 24 to store firmware code including the code implementing the algorithms described below, RAM 26, a countdown timer 30, a radio module or circuit 32 and a flasher activation circuit 34. The radio module 32 of the preferred embodiment is a Synapse RF200™ operating in the unlicensed 2.4 GHz band. Microcontroller 20 may be a Texas Instruments MSP430 which includes an integral countdown timer.

When a pedestrian approaches a crosswalk assembly and presses the activation button 16, or if the proximity or motion sensor 17 is triggered or some other triggering event occurs, the processor 22 of the assembly in question (the "originating assembly") configures a set of flashing initiation broadcast signals that are transmitted by radio module 32 at different time intervals in advance of the actual desired flashing start time. The desired flashing start time is predetermined as a particular time after the triggering event has occurred. Each transmitted signal packet includes a countdown time or a countdown time token equivalent to the amount of time that the signal is transmitted in advance of the desired flashing start time. The last such signal may be transmitted at the desired flashing start time with a countdown time of zero or a countdown time token representative of zero as will be explained below.

Figure 4:
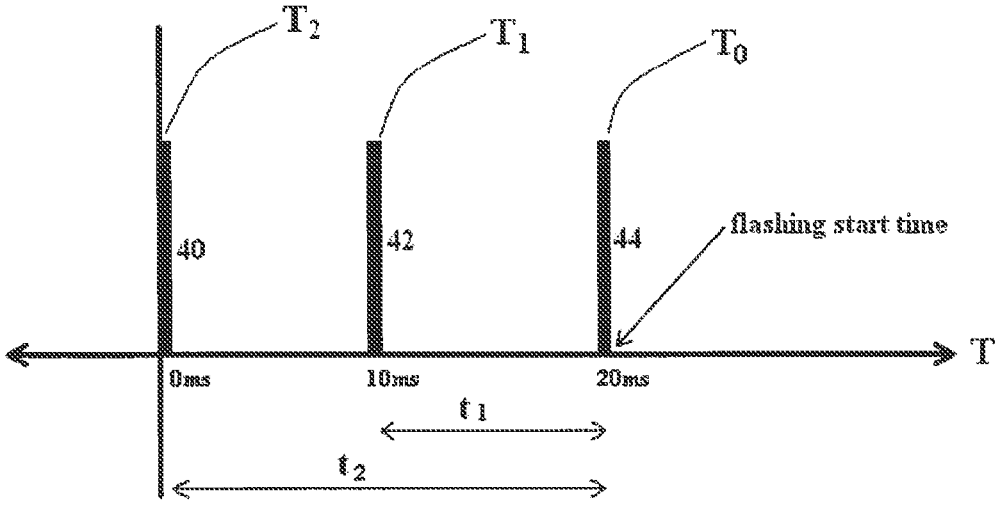
FIG. 4 is a timing diagram of an exemplary 3-signal broadcast protocol according to the preferred embodiment.

FIG. 4 and Table 1 show an example where three signals 40, 42, 44 are sent in response to a pedestrian pressing the activation button 16. The first signal 40 is sent at the time the pedestrian presses the activation button 16 and is transmitted with a 20 ms timing delay instruction. The second signal 42 is sent 10 ms after the pedestrian presses the activation button 16 and is transmitted with a 10 ms timing delay instruction. The third signal 44 is sent 20 ms after the pedestrian presses the activation button 16 and is transmitted with a 0 ms timing delay instruction. The result of the multiple signals transmitted with unique timing delay instructions is that as long as one of the multiple signals is received, the receiving crosswalk warning assembly will flash in a coordinated pattern with the transmitting crosswalk warning assembly and any other crosswalk warning assemblies that received at least one of the multiple signals.

TABLE 1

| | $T_2$ | $T_1$ | $T_0$ |
|---|---|---|---|
| Time before Activation | 20 ms | 10 ms | 0 ms |
| Time delay instruction | $t_2$ = 20 ms | $t_1$ = 10 ms | $t_0$ = 0 ms |

For example in a three signal protocol illustrated in FIG. 4 and Table 1, a first signal $T_2$ is transmitted by radio module 32 a time period of 20 ms prior to the desired flashing start time. Signal $T_2$ is typically a digital packet and the packet includes the countdown time period $t_2$=20 ms. A second signal $T_1$ is transmitted 10 ms prior to the same desired flashing start time, where $t_1<t_2$. In the present three signal example, $t_1 \neq 0$. The countdown time period $t_1$=10 ms is transmitted as part of signal $T_1$. The third signal $T_0$ is transmitted simultaneously with the desired flashing start time with a countdown time period of $t_0$=0 ms or no countdown period to indicate the immediate initiation of the flashing. Coincident with the broadcasting of the $T_0$ signal, processor 22 also causes the beacon on the originating assembly to also commence flashing by activating and controlling the flasher activation circuit 34.

Upon another assembly receiving the signal $T_2$, that assembly's processor 22 reads the countdown number $t_2$ in the signal and initializes and starts the countdown timer 30 with a countdown time of $t_2$. Upon $t_2$ ms having elapsed, the control unit 20 initiates the flashing of its beacon. If the $T_2$ signal is not received due to interference, the same protocol would be followed for the $T_1$ signal, such that the countdown timer is initialized and started with a countdown time of $t_1$, resulting in the same flashing start time. If the $T_1$ signal is not received due to interference, the $T_0$ signal would also result in the same flashing start time.

In the preferred embodiment, if $T_2$ is received and the countdown timer is initiated, but $T_1$ is then received, the more recent $T_1$ signal will be taken as the determinative signal for setting the countdown timer. This approach minimizes issues of signal conflicts or signal propagation and processing delays. Alternatively, the system may be configured such that if either $T_2$ or $T_1$ is successfully received, subsequent signals received within a predetermined time window (preferably equal to $t_2$) are not processed to avoid start time processing conflicts.

Figure 5:
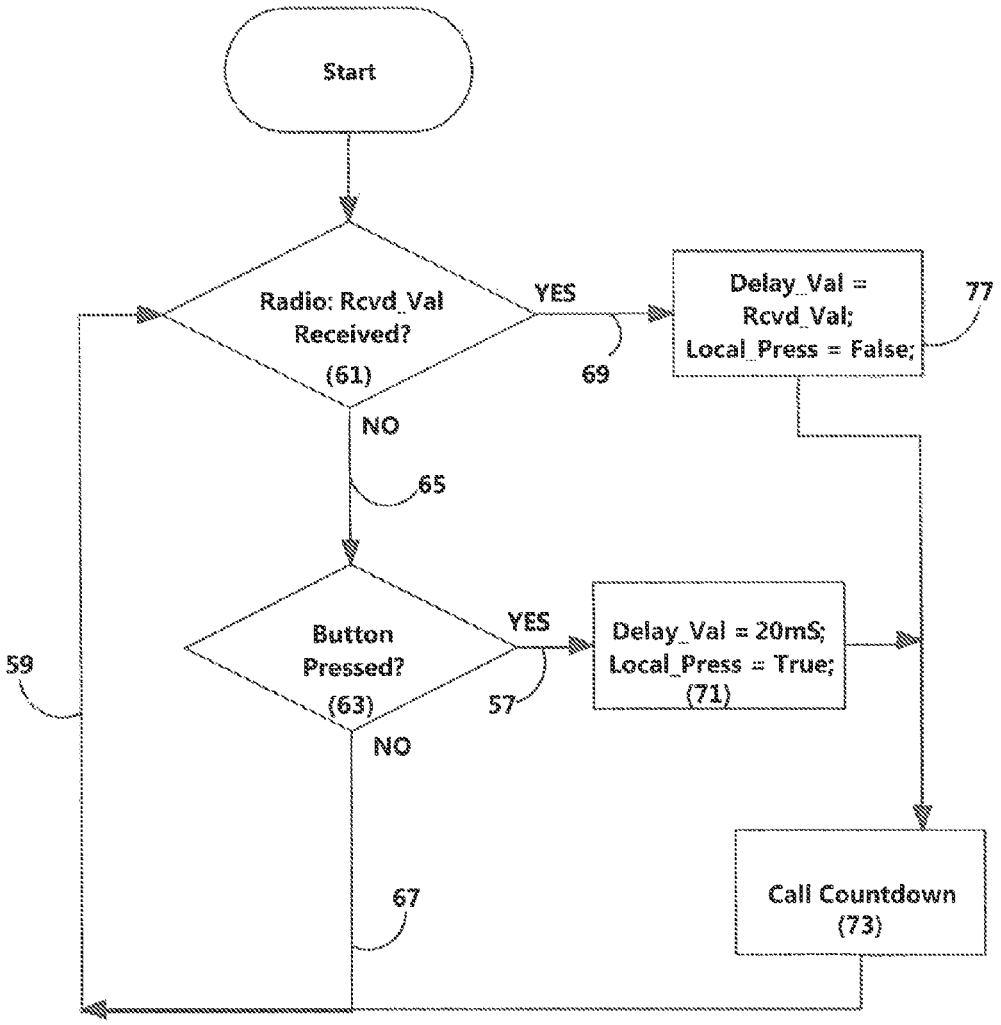
FIG. 5 is a flowchart of the main routine of the preferred embodiment.

FIG. 5 is a flowchart of a main routine for processing beacon flashing initiation signals according to the preferred embodiment. The processor cycles (59) through a loop that monitors for the broadcast from any other assembly of a flashing initiation signal (61) and for the activation of a button or a sensor on its own assembly (63). If no broadcast signal has been received (65) and the assembly's local button has not been pressed (67), then the routine loops (59) to continue monitoring.

If no signal has been received (65) but the assembly's button has been pressed (57), a maximum delay value (Delay_Val), for example 20 ms, is assigned and the state of a variable Local_Press is set as true (71). Delay_Val is a local variable indicative of the countdown time associated with a particular flashing initiation signal. Delay_Val also corresponds to the transmission interval between the broadcast signal and the desired flashing start time.

The preferred embodiment uses a three broadcast signal protocol and predetermined a sequence of smaller time intervals $t_2$, $t_1$ and $t_0$=0 ms. When the button has been pressed, the processor will cause the radio to broadcast a first signal that includes a time parameter of $t_2$ ms. Accordingly, the Delay_Val at step 71 is set to the value of $t_2$ ms. The routine then invokes the Call Countdown subroutine 73 which, as will be seen, will either simply cause its local countdown timer to count down $t_2$ ms before activating the flasher, or it will allow the receipt of a broadcast signal from another assembly to override the current countdown by setting a new countdown time, i.e. by setting a new Delay_Val value. In the latter case, competing activation signals from two or more assemblies are effectively resolved by allowing the more recently broadcast signal to override the previously broadcast signals.

If, instead of the assembly's button being pressed, a flashing initiation signal has been received (69), then the countdown time embodied in the signal, known as Rcvd_Val, is set (77) as Delay_Val to be used as the local countdown value for further processing. In this case, as Delay_Val was set as the result of a received signal rather than the pressing of the assembly's own button, the state of a variable known as Local_Press is set as false (77). As Delay_Val has been drawn from the received signal that was broadcast from another assembly, Delay_Val may be $t_2$ ms, $t_1$ ms or 0 ms. The Call Countdown subroutine is then invoked. As will be seen, the Call Countdown subroutine will count down the time delay determined by Delay_Val value and the next decrement value (e.g. the predetermined time delay represented by the transition from $t_2$ to $t_1$ and by $t_1$). Alternatively, if another flashing initiation signal is received during the countdown phase, that signal will be used to override and reset Delay_Val for countdown purposes by substituting its Rcvd_Val as the new Delay_Val.

Figure 6:
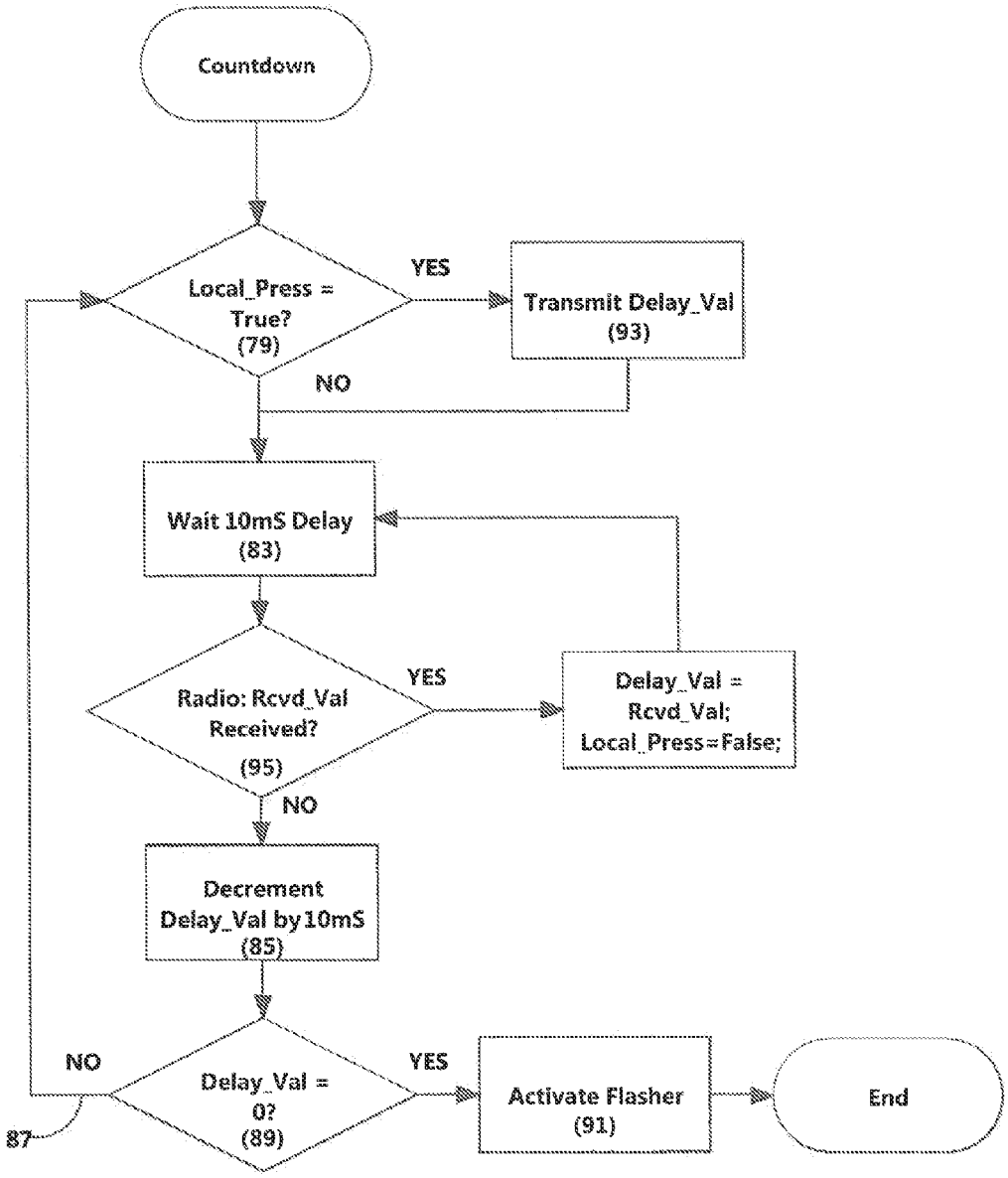
FIG. 6 is a flowchart of the Call Countdown subroutine according to the preferred embodiment.

FIG. 6 is a flowchart of the Call Countdown subroutine for the alternate embodiment. The first decision (79) determines whether the state of Local_Press is true or false. If false, then the subroutine must have been invoked due to a flashing initiation signal received from another assembly. This effectively determines that the processor running the subroutine need not be concerned with broadcasting signals to others (which is already being done by the transmitting assembly) and that it need only initiate a countdown for the flashing of its own beacon. When decision 79 has thus determined that the subroutine was invoked because of a received signal rather than the pressing of its local button, it proceeds to wait (83) a predetermined time interval assigned to the transition from Delay_Val to the next decremented value of Delay-Val. If Delay_Val=$t_2$ then the time interval at 83 will be predetermined to be the time interval between $t_2$ and $t_1$, the values of $t_2$ and $t_1$ being predeterminable throughout the crosswalk system. In the present example, the difference between $t_2$ and $t_1$ is 10 ms, such that $t_2$=20 ms, $t_1$=10 ms and $t_0$=0 ms.

In the normal course, the subroutine proceeds to decrement (85) Delay_Val to the next lower value of Delay_Val, for example from 20 ms to 10 ms if the most recent value of Delay_Val was 20 ms. If the value of Delay_Val has not yet reached zero (87), then the process returns to step 79. In this example, Local_Press was false and accordingly a further time delay (83) is allowed to run down. Again, the time delay corresponds to the predetermined time interval assigned to the transition between the current value of Delay-Val and the next decremented value thereof (for example the time interval predetermined as the difference of 10 ms between $t_2$ and $t_1$, which is also the value of $t_1$). The value of Delay_Val is decremented (85) and is once again checked to see whether its value is now zero (89). If so, flashing of the beacon is activated (91) and the subroutine returns control to the main routine. Although not shown, the main routine may include a timer delay to interrupt the main routine's process until the flashing period initiated by the subroutine plus any subsequent predetermined wait period has been allowed to elapse before the main routine is allowed to trigger another flashing sequence.

If the subroutine of FIG. 6 was invoked because the assembly's local button was pressed rather than from having received a flashing initiation broadcast signal from another assembly, the state of Local_Press in decision 79 will be true. It follows that the value of Delay_Val will also be at the maximum predetermined value for that variable as the first broadcast signal will be for the longest countdown period. In the present three signal protocol example, that value would be $t_2$=20 ms. That the subroutine was invoked because the local button was pressed also implies that the assembly is an originating assembly and that it must arrange to broadcast flashing initiation signals to the other assemblies. Accordingly, the process proceeds from decision 79 to the broadcast transmission (93) of Delay_Val (which in this case will be 20 ms). The process proceeds to wait (83) for the predetermined interval of 10 ms. In the normal course, the process proceeds to decrement (85) Delay_Val by 10 ms. As Delay_Val is not yet equal to zero (89), the process cycles to step 79. As the present example assumes that the assembly's own button triggered this subroutine, the new value of Delay_Val (which is now 10 ms) is broadcast as the second flashing initiation broadcast signal. A further delay representing the period between a Delay_Val of $t_1$ (in this example another 10 ms) is allowed to run (83) before decrementing Delay_Val from 10 ms to 0 ms. As Delay_Val is now equal to zero (89), flashing of the assembly's beacon is activated (91). According to the invention the flashing of the beacon should coincide with the flashing of the beacons at any of the other assemblies that have received any of the three broadcast signals.

If in the course of the subroutine's process a flashing initiation signal is received from another beacon, that event is detected at step 95. When that occurs, Delay_Val is reset as the value of Rcvd_Val, i.e. the countdown time from the received broadcast is allowed to override the previously current countdown time, embodied as Delay_Val. In the present example, that value may now be 20 ms (if $t_2$ was the value received), or 10 ms (if $t_1$ was received) or 0 ms (if $t_0$ was received). In addition, if the subroutine has been invoked because of the pressing of the assembly's own button, that is also overridden by resetting the state of Local_Press to false. The subroutine then proceeds on the basis of the received countdown value Delay_Val=Rcvd_Val. The process allows the Delay_Val decrement intervals to elapse (83), and will decrement Delay_Val (85) until it reaches zero at which time the flasher will be activated (91).

In an alternate embodiment, the countdown number, instead of directly indicating the amount of countdown time to apply, may comprise a number such as 2, 1 or 0 to indicate which signal in a three signal protocol is being transmitted. All initiation signals are transmitted at predetermined time intervals and all processors associate the 2, 1 or 0 numbers with specific countdown periods corresponding to the transmission intervals.

It will be appreciated that a different number of signals, a different length of time between signals, and different timing delay instructions can all be used. It is noted that an increase in the number of signals, the length of time between signals, or the timing delay instructions comes at the expense of the reaction time between the pressings of the activation button by the pedestrian and the flashing of the signaling beacons.

Figure 7:
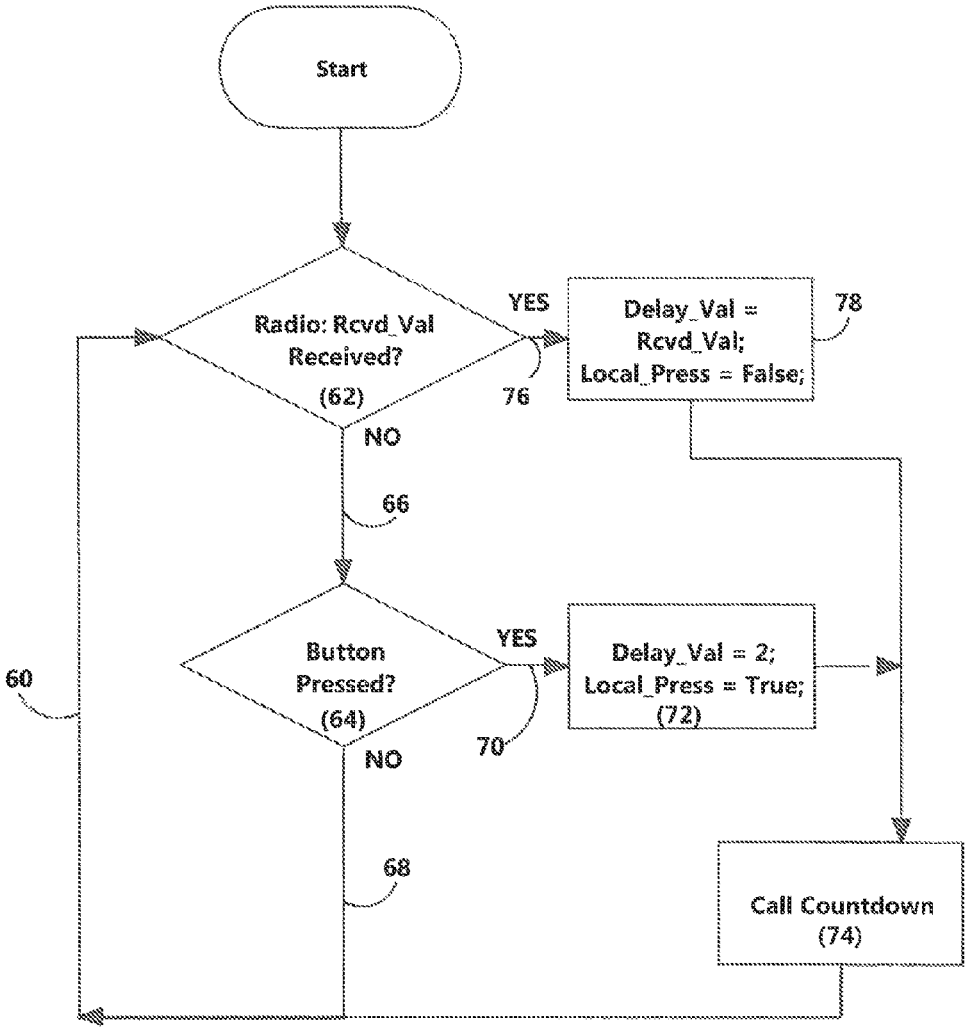
FIG. 7 is a flowchart of the main routine of an alternate embodiment.

FIG. 7 is a flowchart of a main routine for processing flashing initiation signals according to such alternate embodiment. The processor cycles (60) through a loop that monitors for the broadcast from any other assembly of a flashing initiation signal (62) and for the activation of a button or a sensor on its own assembly (64). If no broadcast signal has been received (66) and the assembly's local button has not been pressed (68), then the routine loops (60) to continue monitoring.

If no signal has been received (66) but the assembly's button has been pressed (70), a maximum delay value (Delay_Val) is assigned and the state of a variable Local_Press is set as true (72). Delay_Val is a local variable indicative of the countdown time associated with a particular flashing initiation signal. Delay_Val also corresponds to the transmission interval between the broadcast signal and the desired flashing start time.

This embodiment uses a three broadcast signal protocol and predetermined interval tokens such as 2, 1 and 0. When the button has been pressed, the first signal to be broadcast will include the first token ("2") of the token sequence. Accordingly, the Delay_Val at step 72 is set to the maximum value of 2. The routine then invokes the Call Countdown subroutine 74 which, as will be seen, will either simply cause its local countdown timer to count down a predetermined time corresponding to the interval token "2" before activating the flasher, or it will allow the receipt of a broadcast signal from another assembly to override the current countdown by setting a new countdown time, i.e. by setting a new Delay_Val value. In the latter case, competing activation signals from two or more assemblies are resolved by allowing the more recently broadcast signal to override the previously broadcast signals.

If, instead of the assembly's button being pressed, a flashing initiation signal has been received (76), then the countdown time corresponding to the interval token that is embodied in the received signal, known as Rcvd_Val, is set (78) as Delay_Val to be used as the local countdown value for further processing. In this case, as Delay_Val was set as the result of a received signal rather than the pressing of the assembly's own button, the state of a variable known as Local_Press is set as false (78). As Delay_Val has been drawn from the received signal that was broadcast from another assembly, Delay_Val may be 2 or 1 or 0. The Call Countdown subroutine is then invoked. As will be seen, the Call Countdown subroutine will count down the predetermined time delay between the actual Delay_Val value and the next decrement value (e.g. the predetermined time delay represented by the transition from 2 to 1, or from 1 to 0 as the case may be). Alternatively, if another flashing initiation signal is received during the countdown phase, that signal will be used to override and reset Delay_Val for countdown purposes by substituting its Rcvd_Val as the new Delay_Val.

Figure 8:
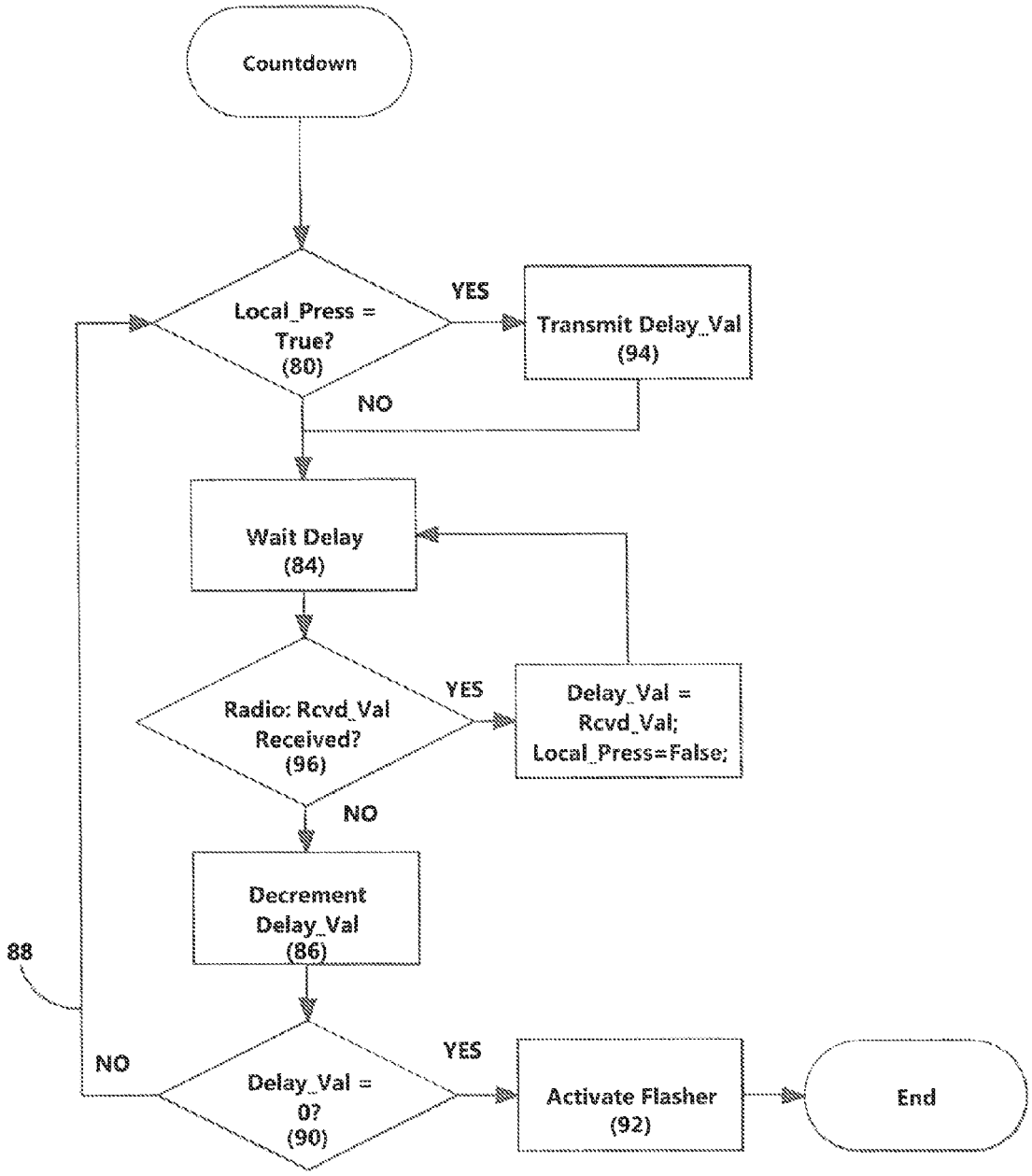
FIG. 8 is a flowchart of the Call Countdown subroutine according to the alternate embodiment.

FIG. 8 is a flowchart of the Call Countdown subroutine for the alternate embodiment. The first decision (80) determines whether the state of Local_Press is true or false. If false, then the subroutine must have been invoked due to a flashing initiation signal received from another assembly. This effectively determines that the processor running the subroutine need not be concerned with broadcasting signals to others (which is already being done by the transmitting assembly) and that it need only initiate a countdown for the flashing of its own beacon. When decision 80 has thus determined that the subroutine was invoked because of a received signal rather than the pressing of its local button, it proceeds to wait (84) the predetermined time interval assigned to the transition from Delay_Val to the next decremented value of Delay-Val. In the normal course, the subroutine proceeds to decrement (86) Delay_Val to the next lower value of Delay_Val, for example from 2 to 1. If the value of Delay_Val has not yet reached zero (88), then the process returns to step 80. In this example, Local_Press was false and accordingly a further time delay (84) is allowed to run down. Again, the time delay corresponds to the predetermined time interval assigned to the transition between the current value of Delay-Val and the next decremented value thereof (for example the time interval assigned to the transition from 1 to zero). The value of Delay_Val is decremented (86) and is once again checked to see whether its value is now zero (90). If so, the flasher is activated (92) and the subroutine returns control to the main routine. Although not shown, the main routine may include a timer delay to interrupt the main routine's process until the flashing period initiated by the subroutine plus any subsequent predetermined wait period has been allowed to elapse before the main routine is allowed to trigger another flashing sequence.

If the subroutine of FIG. 8 was invoked because the assembly's local button was pressed rather than from having received a flashing initiation broadcast signal from another assembly, the state of Local_Press in decision 80 will be true. It follows that the value of Delay_Val will also be at the maximum predetermined value for that variable as the first broadcast signal will be for the longest countdown period. In the present three signal protocol example, that value would be 2. That the subroutine was invoked because the local button was pressed also implies that the assembly is an originating assembly and that it must arrange to broadcast flashing initiation signals to the other assemblies. Accordingly, the process proceeds from decision 80 to the broadcast transmission (94) of Delay_Val (which in this case will be 2). The process proceeds to wait (84) for the predetermined interval between a Delay_Val of 2 and a Delay_Val of 1, for example a predetermined period of 10 ms. In the normal course, the process proceeds to decrement (86) Delay_Val from 2 to 1. As Delay_Val is not yet equal to zero (90), the process cycles to step 80. As the present example assumes that the assembly's own button triggered this subroutine, the new value of Delay_Val (which is now 1) is broadcast as the second flashing initiation broadcast signal. A further delay representing the period between a Delay_Val of 1 and a Delay_Val of 0 (for example another 10 ms) is allowed to run (84) before decrementing Delay_Val from 1 to 0. As Delay_Val is now equal to zero (90), flashing of the assembly's beacon is activated (92). According to the invention the flashing of the beacon should coincide with the flashing of the beacons at any of the other assemblies that have received any of the three broadcast signals.

If in the course of the subroutine's process a flashing initiation signal is received from another beacon, that event is detected at step 96. When that occurs, Delay_Val is reset as the value of Rcvd_Val, i.e. the countdown time from the received broadcast is allowed to override the previously current countdown time, embodied as Delay_Val. In addition, if the subroutine has been invoked because of the pressing of the assembly's own button, that is also overridden by resetting the state of Local_Press to false. The subroutine then proceeds on the basis of the received countdown value. The process allows the Delay_Val decrement intervals to elapse (84), and will decrement Delay_Val (86) until it reaches zero at which time the flasher will be activated (92).

In an alternative approach, assuming the system operator may be satisfied that the various assemblies have accurately synchronized clocks, or alternatively that timing is derived from a common external source such as GPS signals, the plurality of signals broadcast by the originating assembly may, instead of identifying a time delay for each of the broadcasts, include a specified universal start time for the flashing (such as a coordinated universal time). Each of the pluralities of signals would therefore indicate the same precise time. Provided that the assemblies are properly synchronized to the same time reference, each of the assemblies would begin flashing at the same time regardless of which of the pluralities of signals is successfully received.

In the foregoing specification, the invention has been described with reference to specific embodiments thereof. However, the scope of the claims should not be limited by the preferred embodiments set forth in the examples, but should be given the broadest interpretation consistent with the description as a whole. The specification and drawings are, accordingly, to be regarded in an illustrative rather than a restrictive sense.

The invention claimed is:

1. A method of synchronizing a plurality of signal or lighting assemblies, the method comprising the steps of:

in response to a triggering event at an originating one of said signal or lighting assemblies, said originating assembly broadcasting a temporal succession of radio signals on the same radio channel, each of said signals comprising a unique flashing initiation timing instruction that is a function of how long in advance of a desired flashing initiation time said signal is broadcast;

at least one other of said assemblies receiving at least one of said signals and determining said desired flashing initiation time; and said originating assembly and said at least one other assembly causing beacons on their respective assemblies to flash in a synchronized manner in response to receiving said at least one of said signals.

2. The method of claim 1 wherein said triggering event is the manual activation of a user interface on said originating assembly.

3. The method of claim 1 wherein the step of broadcasting a temporal succession of radio signals comprises:

configuring a set of radio signals to be broadcast in timed succession, each of said signals comprising a unique flashing initiation timing instruction that is a function of how long in advance of a desired flashing initiation time said signal is to be broadcast; and, broadcasting each signal in said set of signals in temporal succession.

4. The method of claim 1 wherein said instruction comprises the actual time period in advance of said desired flashing initiation time that each of said signals is broadcast.

5. The method of claim 3 wherein said instruction comprises the actual time period in advance of said desired flashing initiation time that each of said signals is broadcast.

6. The method of claim 3 wherein said instruction comprises a token representing the position of said signal in the temporal sequence of signals that are broadcast by said originating assembly.

7. The method of claim 6 wherein each of said assemblies associates said token with a predetermined time period in advance of a flashing initiation time.

8. The method of claim 5 or 7 further comprising the step of each of said receiving assemblies monitoring for receipt of another of said signals until said desired flashing initiation time and, where said another of said signals is received, allowing said another of said signals to determine said desired flashing initiation start time.

9. The method of claim 5 or 7 further comprising the step of each of said receiving assemblies monitoring for another triggering event at said respective receiving assembly until said desired flashing initiation time and, where said another triggering event is detected, treating said receiving assembly as an originating one of said assemblies and performing said steps of claim 5.

10. The method of claim 5 further comprising the steps of said originating and receiving assemblies allowing a predetermined time period to elapse after a broadcast of one of said signals that has been received by one of said receiving assemblies, and determining whether another signal has been received or another triggering event has occurred during said predetermined time period, and if not, allowing another predetermined time period to elapse if the desired flashing initiation start time has not yet been reached.

11. In a signal or lighting assembly comprising a beacon, radio signal receiving and broadcasting means and a user interface for allowing a user to trigger the flashing of said beacon, said assembly further comprising a computer readable medium having stored thereon instructions that, when executed by a processor, cause the following steps to be implemented:

in response to an activation of said user interface, said assembly broadcasting a temporal succession of radio signals on the same radio channel, each of said signals comprising a unique flashing initiation timing instruction that is a function of how long in advance of a desired flashing initiation time said signal is broadcast, and causing said beacon to begin flashing at said desired flashing initiation time;

in response to receipt from another like assembly of a like radio signal, causing said beacon to begin flashing at a flashing initiation time determined by said like radio signal.

12. The assembly of claim 11 wherein said step of broadcasting comprises the steps of;

configuring a set of radio signals to be broadcast in timed succession, each of said signals comprising a unique flashing initiation timing instruction that is a function of how long in advance of a desired flashing initiation time said signal is to be broadcast; and, broadcasting each signal in said set of signals in temporal succession.

13. The assembly of claim 12 wherein said instruction comprises the actual time period in advance of said desired flashing initiation time that each of said signals is broadcast.

14. The assembly of claim 12 wherein said instruction comprises a token representing the position of said signal in the temporal sequence of signals that are broadcast by said assembly.

15. The assembly of claim 14 wherein said assembly associates said token with a predetermined time period in advance of a flashing initiation time.

16. The assembly of claim 13 or 14 wherein said steps further comprise the step of said assembly monitoring for receipt of another of said signals until said desired flashing initiation time and, where said another of said signals is received, allowing said another of said signals to determine said desired flashing initiation start time.

17. A signal or lighting system comprising a plurality of signal or lighting assemblies, each of said assemblies comprising a beacon, radio signal receiving and broadcasting means and a user interface for allowing a user to trigger the flashing of said beacon, each of said assemblies further comprising a computer readable medium having stored thereon instructions that, when executed by a processor, cause the following steps to be implemented:

in response to an activation of said user interface of an originating one of said assemblies, said originating assembly broadcasting a temporal succession of radio signals on the same radio channel, each of said signals comprising a unique flashing initiation timing instruction that is a function of how long in advance of a desired flashing initiation time said signal is broadcast, and causing said beacon to begin flashing at said desired flashing initiation time;

at least one other of said assemblies receiving at least one of said signals and determining said desired flashing initiation time; and said originating assembly and said at least one other assembly causing beacons on their respective assemblies to flash in a synchronized manner in response to receiving said at least one of said signals.

18. The method of claim 1 wherein said signal or lighting assemblies are crosswalk warning assemblies.

19. The assembly of claim 11 wherein said signal or lighting assembly is a crosswalk warning assembly.

20. The system of claim 17 wherein said signal or lighting system is a crosswalk warning system and wherein said signal or lighting assemblies are crosswalk warning assemblies.

* * * * *